US011346153B2

(12) United States Patent
Lin

(10) Patent No.: US 11,346,153 B2
(45) Date of Patent: May 31, 2022

(54) LADDER

(71) Applicant: Chen-Wei Lin, Tainan (TW)

(72) Inventor: Chen-Wei Lin, Tainan (TW)

( * ) Notice: Subject to any disclaimer, the term of this patent is extended or adjusted under 35 U.S.C. 154(b) by 518 days.

(21) Appl. No.: 16/178,941

(22) Filed: Nov. 2, 2018

(65) Prior Publication Data

US 2020/0141185 A1 May 7, 2020

(51) Int. Cl.
*E06C 7/18* (2006.01)
*E06C 7/16* (2006.01)
*E06C 1/04* (2006.01)

(52) U.S. Cl.
CPC ..... *E06C 7/187* (2013.01); *E06C 7/16* (2013.01); *E06C 1/04* (2013.01)

(58) Field of Classification Search
CPC ... E06C 7/12; E06C 7/16; E06C 7/086; E06C 7/186; E06C 7/187; E06C 1/04
USPC ..... 182/8
See application file for complete search history.

(56) References Cited

U.S. PATENT DOCUMENTS 226,798 A * 4/1880 Sichel ..... E06C 7/12 182/208
1,916,208 A * 7/1933 Diou ..... E06C 7/187 182/8
2,632,592 A * 3/1953 Eisman ..... E06C 1/32 182/194
3,156,465 A * 11/1964 Jacobi ..... A63B 23/12 482/37
3,200,904 A * 8/1965 Weeks ..... A63B 27/04 182/134
3,348,632 A * 10/1967 Swager ..... E06C 7/187 182/36
3,410,364 A * 11/1968 Fountain ..... E06C 7/187 182/9
3,760,902 A * 9/1973 Nyman ..... E06C 7/16 182/103
3,885,647 A * 5/1975 Acosta ..... E06C 7/187 182/8
3,910,378 A * 10/1975 Nyman ..... E06C 7/48 182/103

(Continued)

FOREIGN PATENT DOCUMENTS

DE 102011009049 A1 * 7/2012 ..... A62B 35/0081
DE 202012010253 U1 * 2/2013 ..... E06C 7/187

(Continued)

*Primary Examiner* — Colleen M Chavchavadze
*Assistant Examiner* — Candace L Bradford
(74) *Attorney, Agent, or Firm* — Rosenberg, Klein & Lee

(57) ABSTRACT

A ladder is revealed. A sliding rail is formed on a surface of one side of each of two ladder poles of a ladder body. At least one sliding block is mounted and sliding in the sliding rail of the ladder pole. An assembly member is arranged between the sliding blocks of the ladder poles. A ring on user's safety clothing is set on the center of the assembly member and connected to the assembly member during climbing. When the user falls off the ladder accidentally, the sliding blocks connected to the assembly member are also pulled so that the sliding blocks are inclined an angle and the braking end within the sliding rail is against the wall of the sliding rail for braking and slip resistance. Thereby the descending is slowed down and the ladder safety during climbing is improved.

9 Claims, 17 Drawing Sheets

(56) References Cited

U.S. PATENT DOCUMENTS 3,933,220 A * 1/1976 Swager ..... H01L 21/32 257/E21.258
3,968,858 A * 7/1976 Vollan ..... A63B 27/00 182/135
4,121,689 A * 10/1978 Bonvin ..... A62B 1/10 182/3
4,130,177 A * 12/1978 Randolph ..... E06C 7/187 182/8
4,269,284 A * 5/1981 Swager ..... E06C 7/187 182/8
4,702,347 A * 10/1987 Nilsen ..... E06C 1/383 182/8
4,821,843 A * 4/1989 Planchon ..... E06C 1/52 182/163
5,419,409 A * 5/1995 Corulla ..... E06C 7/16 182/174
5,497,849 A * 3/1996 Duffy ..... A63B 27/00 182/136
5,758,745 A * 6/1998 Beggs ..... E06C 1/12 182/213
6,161,647 A * 12/2000 Braden ..... A62B 35/0062 182/8
8,353,387 B2 * 1/2013 Vollenweider ..... E06C 7/187 182/8
2012/0247869 A1 * 10/2012 Anderson ..... E06C 7/187 182/8
2014/0246271 A1 * 9/2014 Davies ..... E06C 7/48 182/103

FOREIGN PATENT DOCUMENTS

DE 202012010253 U1 * 4/2013 ..... E06C 7/187
EP 0418405 A1 * 3/1991 ..... E06C 7/187
EP 2514486 A2 * 10/2012 ..... A62B 35/005
WO WO-9404786 A1 * 3/1994 ..... A62B 35/04

* cited by examiner

LADDER

BACKGROUND OF THE INVENTION

Field of the Invention

The present invention relates to a ladder, especially to a multi-use ladder with improved safety during climbing and convenience in transporting objects.

Description of Related Art

Generally, a ladder available now mainly includes two rails and a plurality of steps. The rails are arranged vertically and correspondingly to each other while the steps are spaced apart and attached between the two rails. When a worker uses a ladder to work at heights, he/she can hold the rails by hands and keep the feet on the steps to move up. However, the user lacks a sturdy sense of security because that only a front half of the foot is in contact with the step while stepping on the step. For the user scared of heights, he/she may feel afraid and fall from a height place owing to foot slips and missteps during climbing.

SUMMARY OF THE INVENTION

Therefore it is a primary object of the present invention to provide a multi-use ladder with higher safety during climbing and convenience in transporting objects.

In order to achieve the above object, a ladder according to the present invention includes a sliding rail formed on a surface of one side of each of two ladder poles of a ladder body, at least one sliding block mounted and sliding in the sliding rail of the respective ladder pole, and an assembly member arranged between the sliding blocks of the ladder poles. A ring of user's safety clothing is placed at the center of the assembly member and connected to the assembly member while climbing the ladder. The sliding blocks connected to the assembly member are also pulled so that the sliding blocks are inclined an angle and the braking end within the sliding rail is against the wall of the sliding rail for braking and slip resistance when the user falls off the ladder owing to foot slips and missteps. Thereby the design of the ladder prevents the user from falling and the ladder safety during climbing is improved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
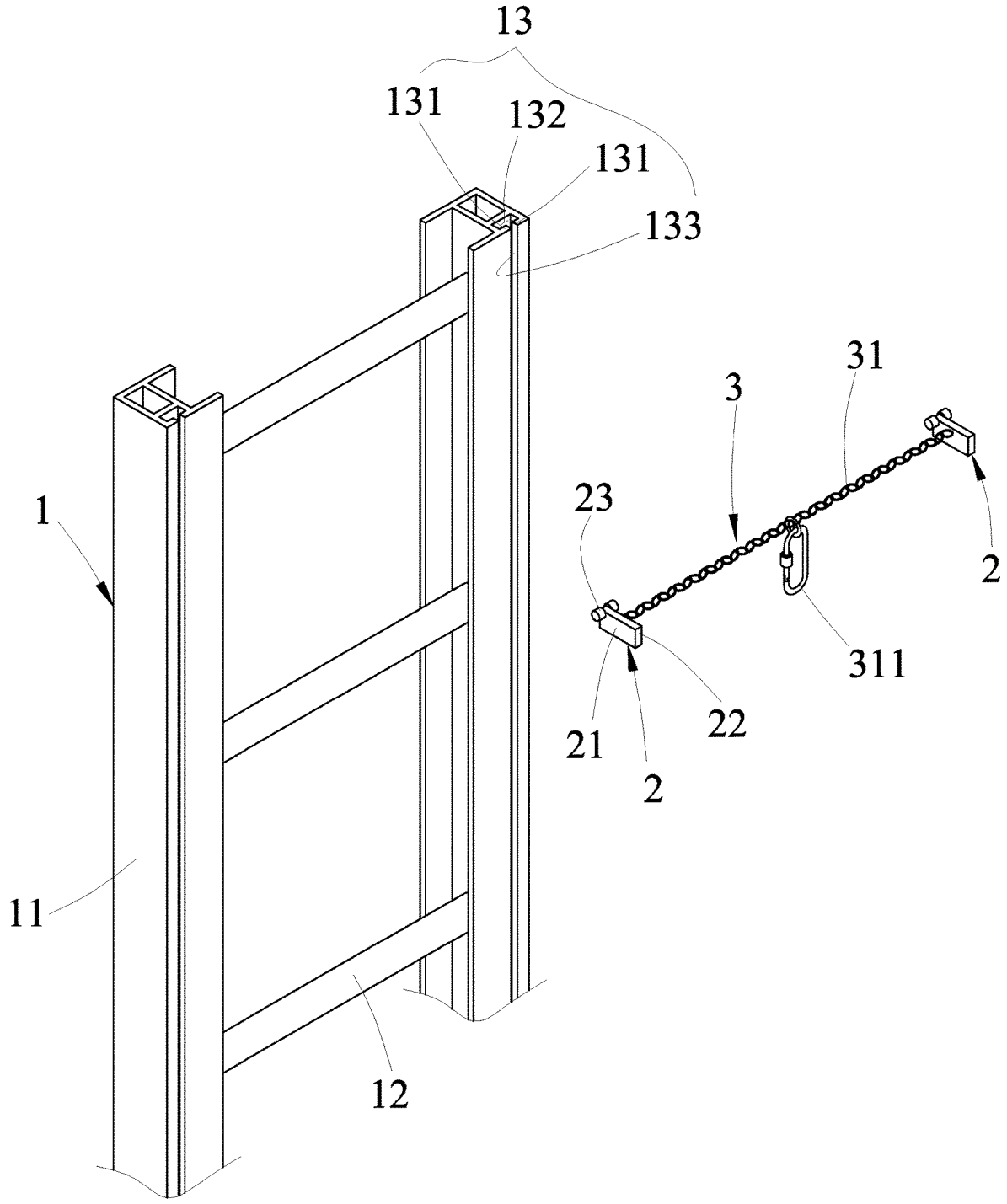
FIG. 1 is an explosive view of an embodiment according to the present invention.
Figure 2:
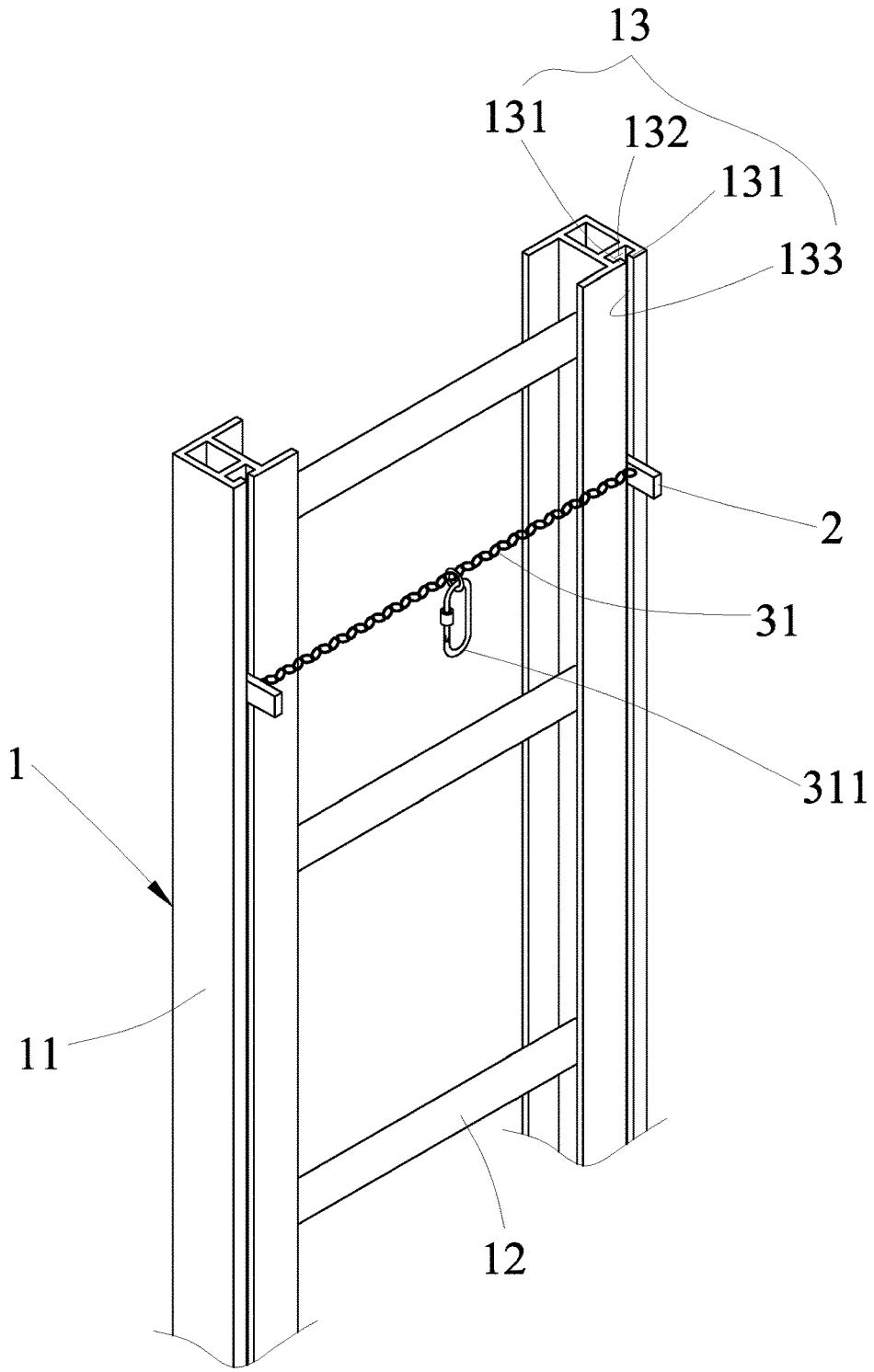
FIG. 2 is a perspective view of an embodiment according to the present invention.
Figure 3:
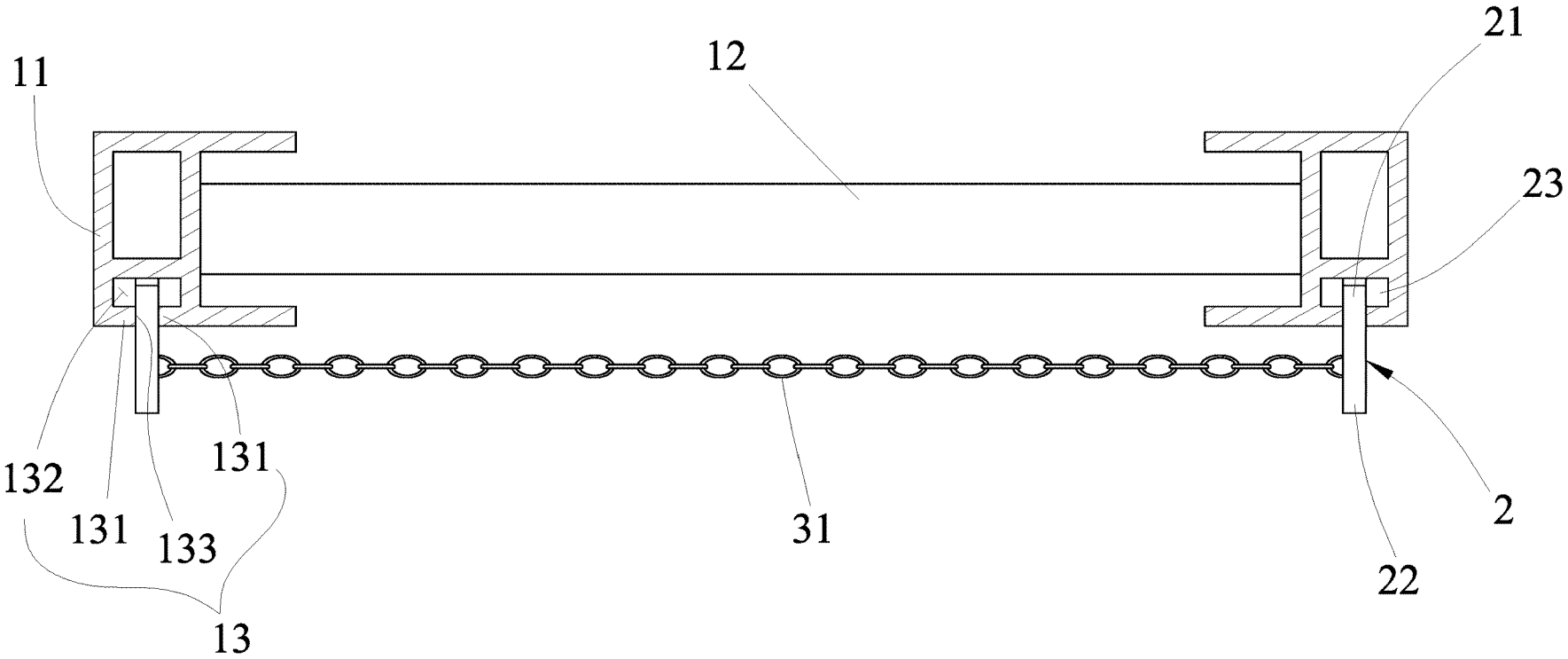
FIG. 3 is a top view of an embodiment according to the present invention.
Figure 4:
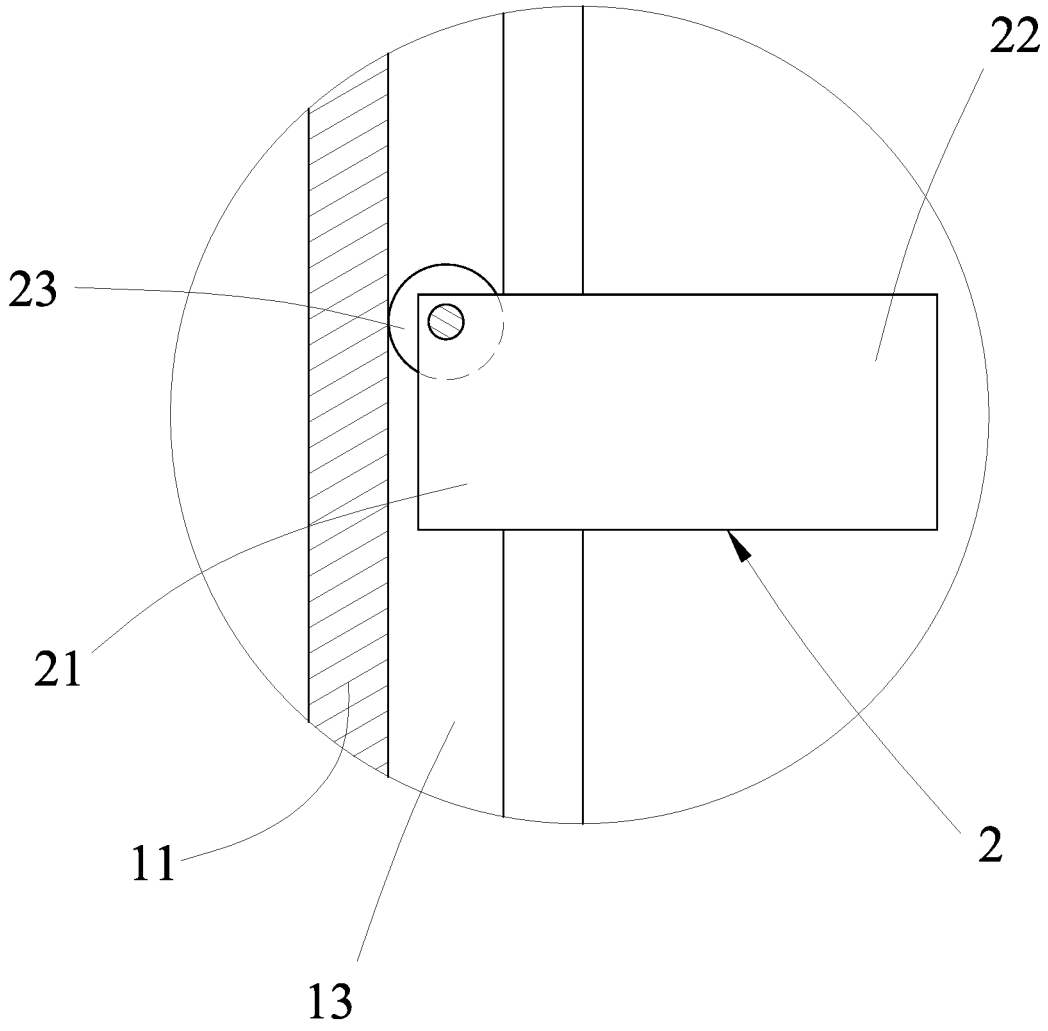
FIG. 4 is a partial sectional view of an embodiment according to the present invention.

Refer to FIG. 1-FIG. 4, a ladder according to the present invention includes at least one ladder body 1, at least two sliding blocks 2, and at least one assembly member 3. The ladder body 1 consists of two vertical ladder poles 11 corresponding to each other, a plurality of horizontal rungs 12 disposed between the two ladder poles 11 and spaced apart, and at least two sliding rails 13 each of which is formed on a surface of least one side of the respective ladder pole 11 and arranged in the length direction. The sliding rail 13 is composed of two corresponding rails 131 protruding from two lateral sides of the surface of the ladder pole 11, a track 132 formed between the two rails 131 and the surface of the ladder pole 11, and an opening 133 that is a gap between the two rails 131. The width of the opening 133 is smaller than the width of the track 132 while the opening 133 is communicating with the track 132.

At least one sliding block 2 is mounted and sliding in the sliding rail 13 of the respective ladder pole 11. The sliding block 2 includes a braking end 21 and an assembly end 22 opposite to each other. The braking end 21 of the sliding block 2 is mounted into the track 132 of the sliding rail 13 and each of two sides of the braking end 21 is provided with a wheel 23. The assembly end 22 of the sliding block 2 is protruding from the opening 133 of the sliding rail 13 to be outside the track 132.

The assembly member 3 is arranged between the two corresponding sliding blocks 2 located at the two ladder poles 11 respectively. The two sides of the assembly member 3 are connected to the assembly ends 22 of the two sliding blocks 2 respectively. The assembly member 3 can be a hook chain 31 that includes a plurality of holes formed thereof and a hook 311 arranged at the hole at the center of the hook chain 31.

Figure 5:
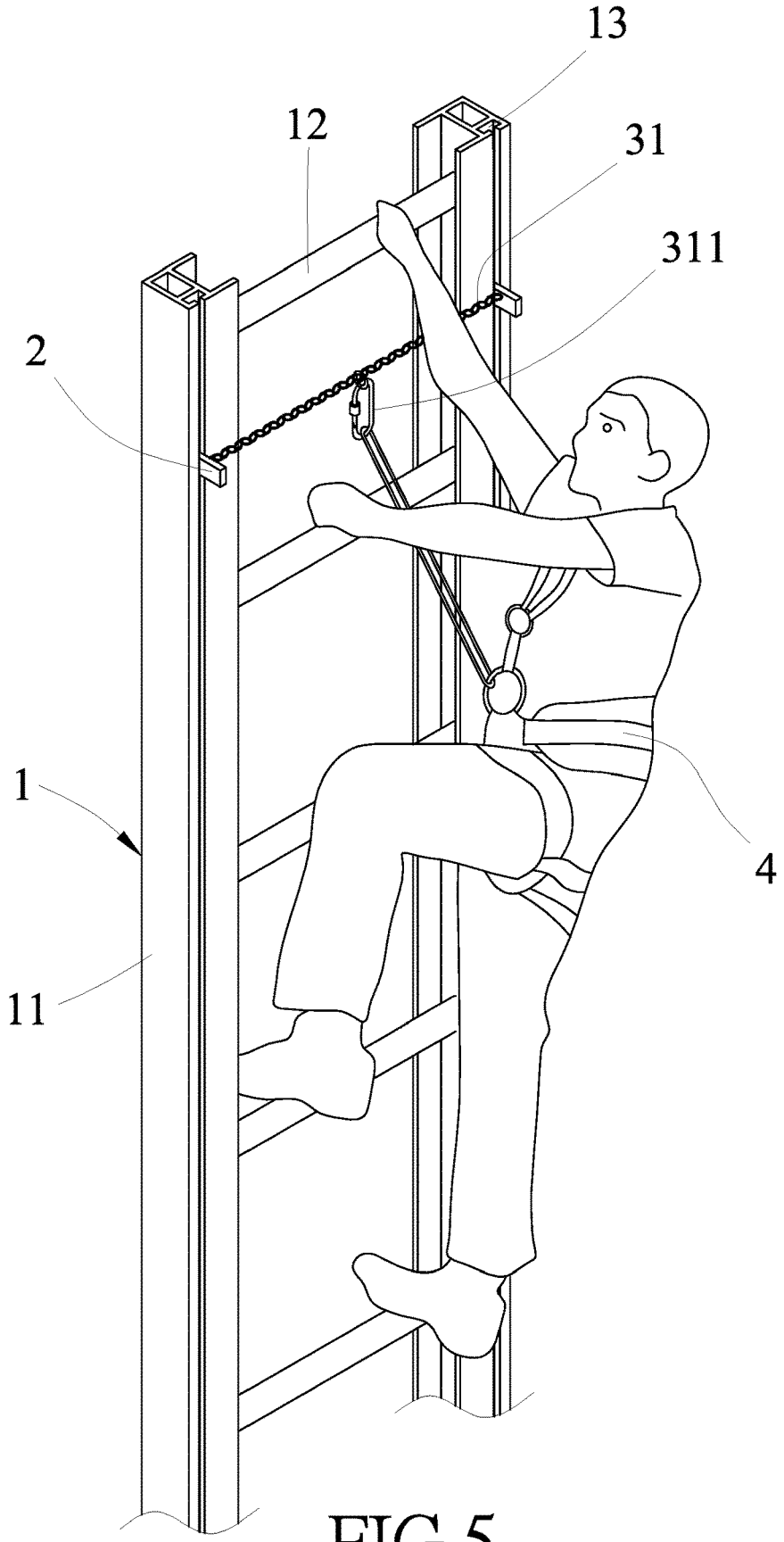
FIG. 5 is a schematic drawing showing an embodiment in use according to the present invention.
Figure 6:
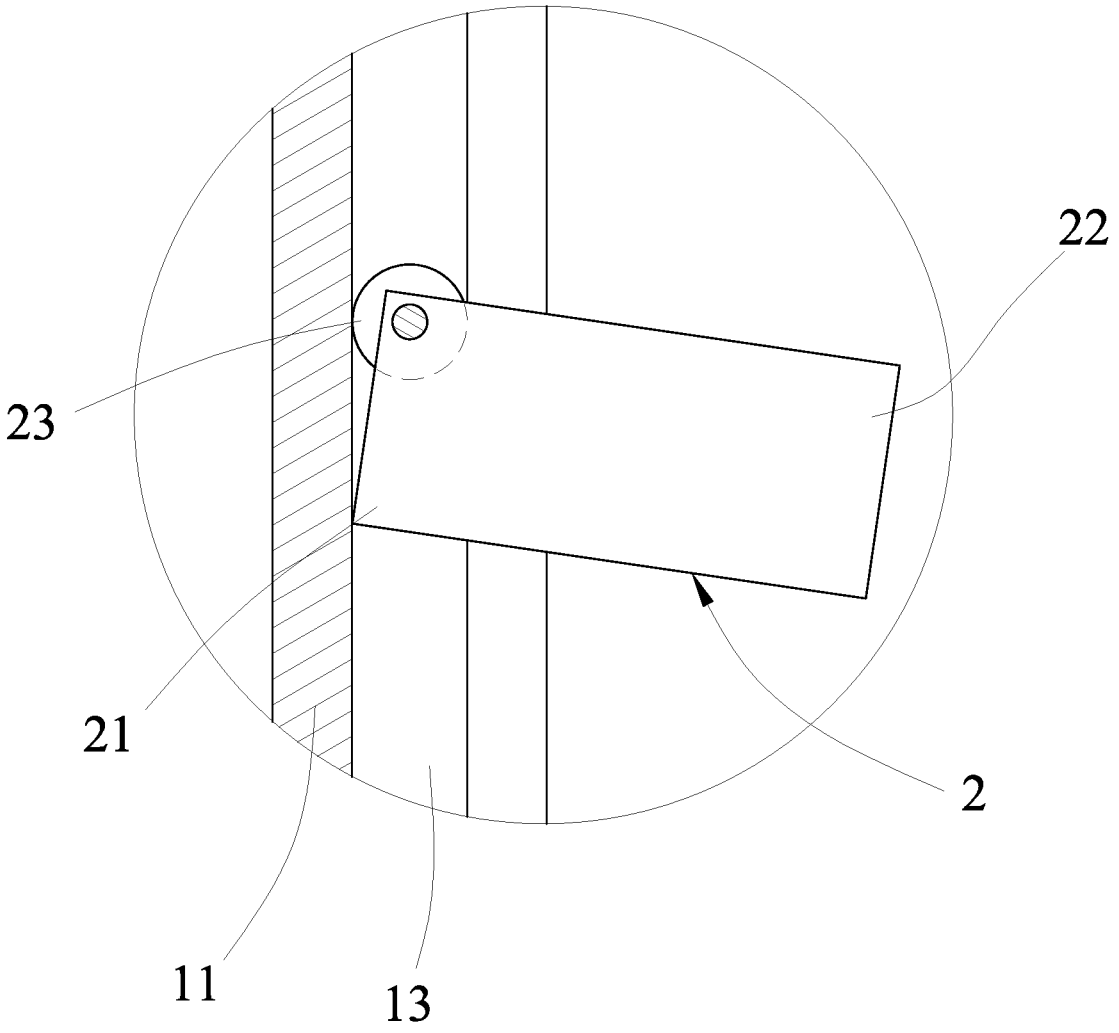
FIG. 6 is a schematic drawing showing a sliding block in a brake state according to the present invention.

As shown in FIG. 5, the user can wear safety clothing 4 that includes a ring hooked with and connected to the hook 311 at the center of the hook chain 31 of the ladder when he/she intends to replace the light fixture, repair the house, or clean something. Then the user can hold the ladder pole 11 of the ladder body 1 by their hands and step on the rungs 12 by their feet to move upward. During the climbing, the users' safety clothing 4 is pulled by the hook chain 31 when the user falls off the ladder accidentally as a result of slips or missteps. Refer to FIG. 6, the sliding blocks 2 on two sides of the hook chain 31 respectively are also pulled so that the braking end 21 within the sliding rail 13 is inclined an angle to be against the wall of the sliding rail 13 of the ladder pole 11 for braking and slip resistance. Thereby the descending is slowed down and the user will not fall down. The ladder safety during climbing is improved.

Figure 7:
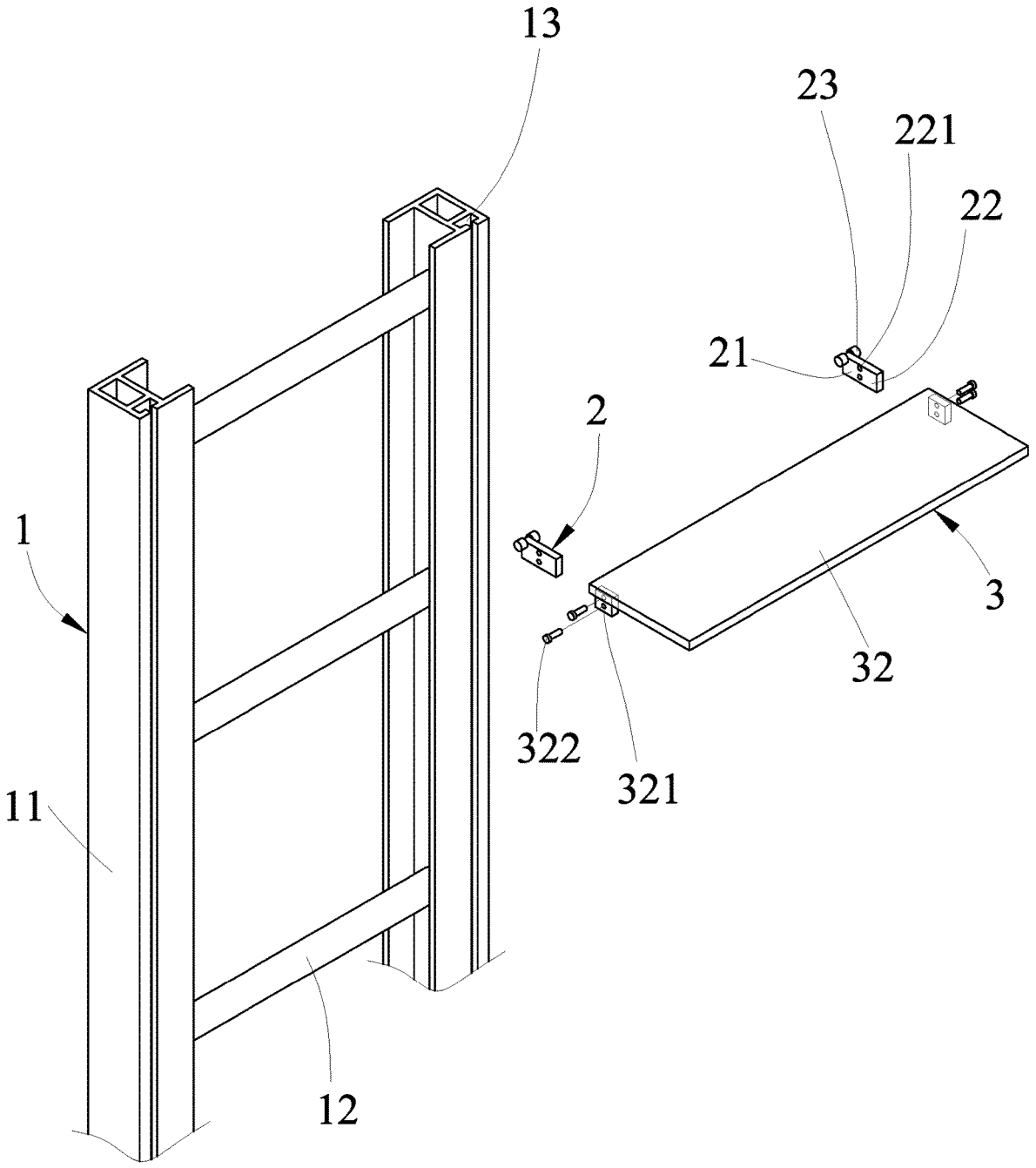
FIG. 7 is an explosive view of another embodiment according to the present invention.
Figure 8:
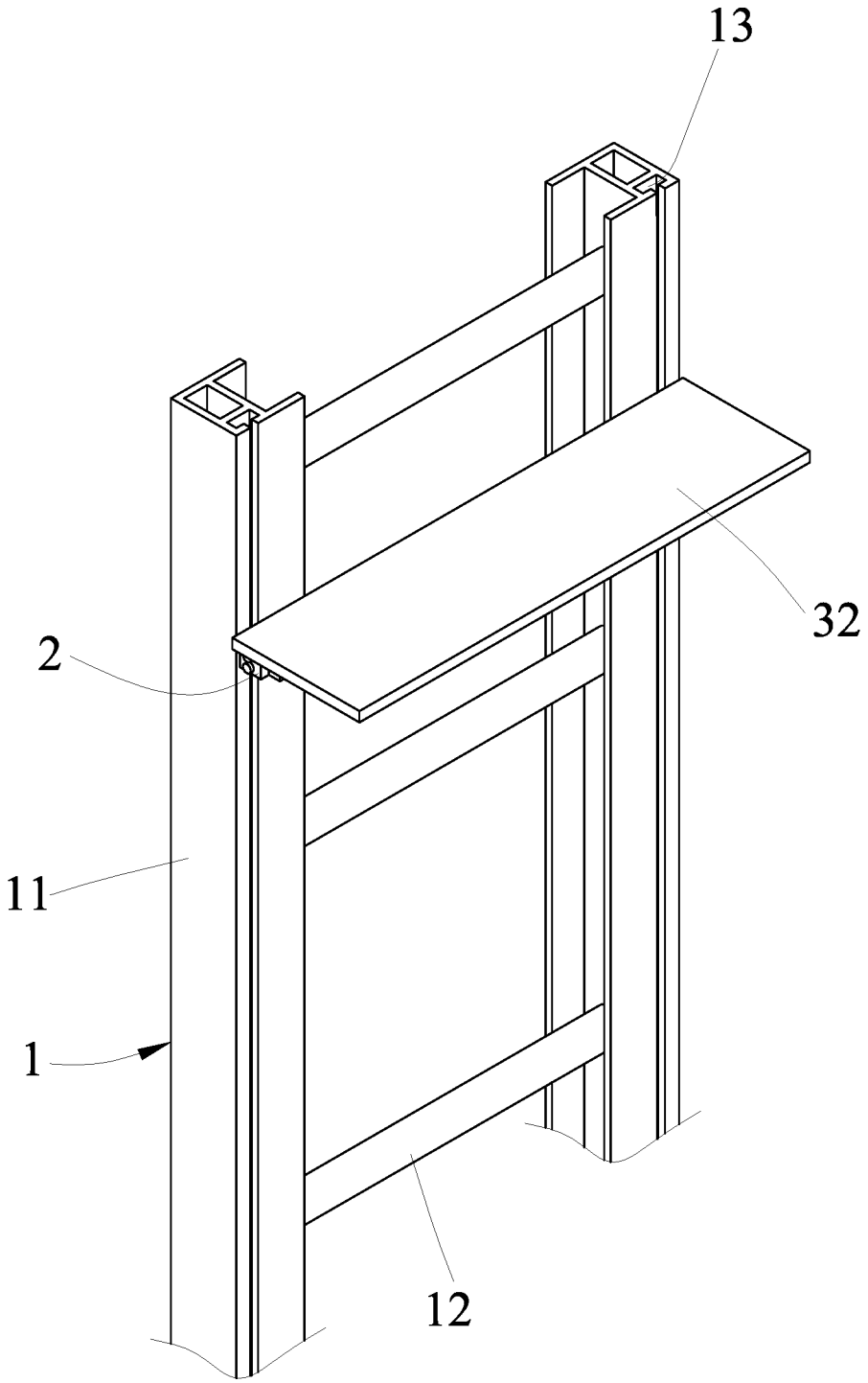
FIG. 8 is a perspective view of another embodiment according to the present invention.

Refer to FIG. 7 and FIG. 8, another embodiment of the present invention is disclosed. The assembly member 3 is a shelf board 32. A plurality of fastening holes 321 is disposed on each of two sides of the shelf board 32 and the assembly end 22 of the sliding block 2 is provided with a plurality of through holes 221 corresponding to the fastening holes 321 on each side of the shelf board 32. A fastener 322 is passed through the through hole 221 of the sliding block 2 and inserted into the fastening hole 321 of the shelf board 32 so as to connect the shelf board 32 and the sliding block 2. In order to move objects or tools to a higher position, first the objects/or the tools are placed on the shelf board 32 and the user moves on the ladder to an elevated place. Once the user reaches the elevation required, the shelf board 32 and the objects/or the tools thereon are pulled upward by a rope preset on the shelf board 32. The sliding block 2 is sliding in the sliding rail 13 smoothly owing to the wheel 23 on the braking end 21 thereof. Thus the shelf board 32 is moved to the position required easily and conveniently. Then the shelf board 32 is released, without being pulled by the user, and is sliding down freely under gravity. At the moment, the sliding blocks 2 arranged at two sides of the shelf board 32 respectively are also pulled so that the braking end 21 within the sliding rail 13 is inclined an angle to be against the wall of the sliding rail 13 of the ladder pole 11 for braking and slip resistance. Thereby the shelf board 32 and the objects/or the tools thereon are fixed on the elevation required. Moreover, the shelf board 32 can be temporarily stopped on the ladder poles 11 when the user intends to rest for a while and stops pulling the rope during the pulling process. Thus the user doesn't need to pull the shelf board 32 with the objects/or the tools thereon to the desired position at once. He/she can apply the force for several times to move the shelf board 32 with the objects/or the tools thereon to the higher position easily. Furthermore, the ladder pole 11 is provided with a plurality of safety hooks. While the user working on the ladder, the ring of the safety clothing 4 on the user is fastened with one of the safety hooks on the ladder pole 11 so as to increase the safety of the work at height. The ladder pole 11 can also be provided with at least one pulley. The rope preset on the shelf board 32 is firstly wound around the pulley and then is pulled by the user. The effort needed to lift the shelf board 32 and the objects/or tools thereon to the position required is decreased. The upper end and the lower end of the ladder pole 11 can be fastened on and connected to the wall surface by fasteners such as screws. Thereby the climbing on the ladder is much safer.

Besides vertical arrangement of the ladder for climbing to high places, the ladder can be set horizontally on/between farmlands or buildings, used as a bridge. Now the assembly member 3 is a bucket with a mounting space formed therein. Two opposite sides of the bottom of the bucket are connected to two sliding blocks respectively. Then a rope is connected to the buckle. Thereby the bucket and objects mounted therein can be moved along the sliding rails of the ladder poles by pulling the rope. The objects can be transported to muddy farmland or between two adjacent buildings conveniently.

Figure 9:
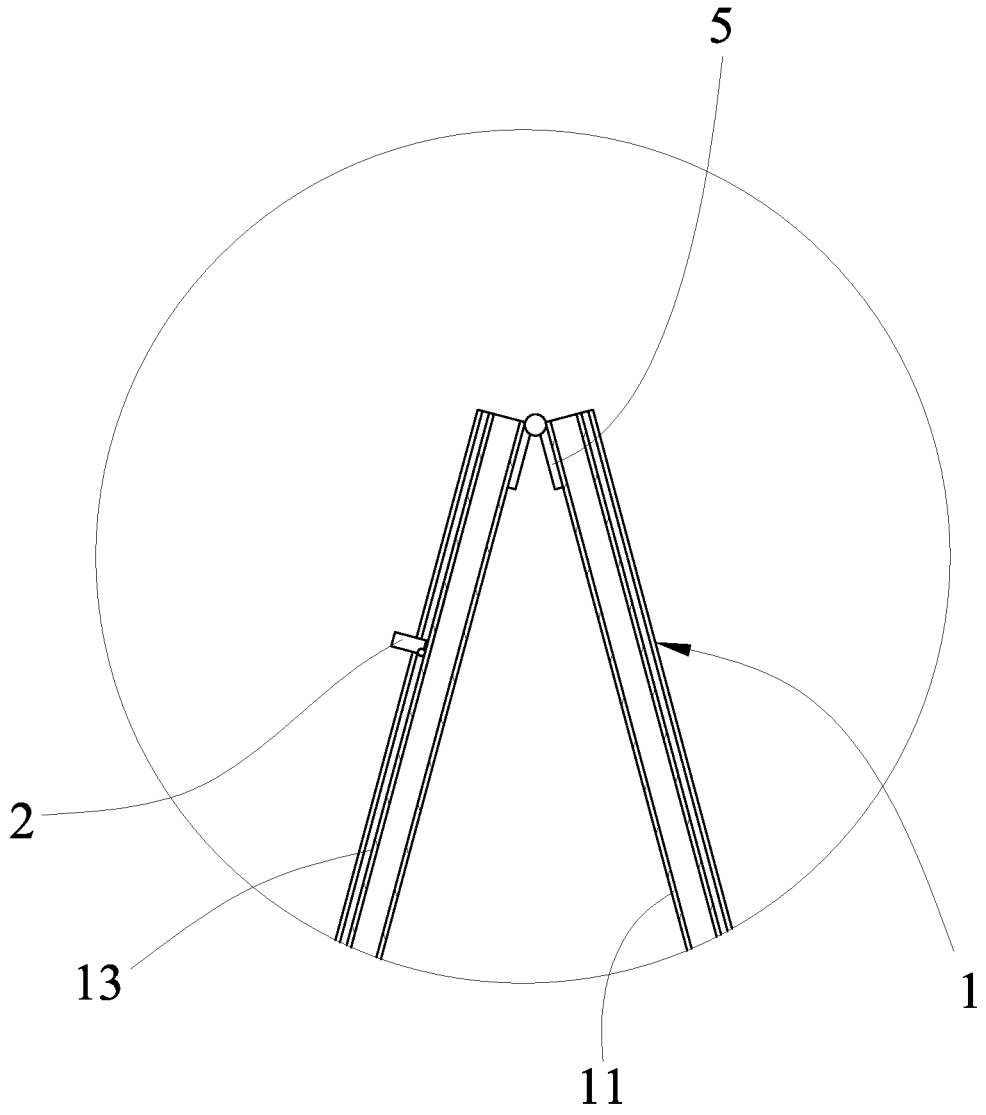
FIG. 9 is a sectional view of a further embodiment according to the present invention.
Figure 10:
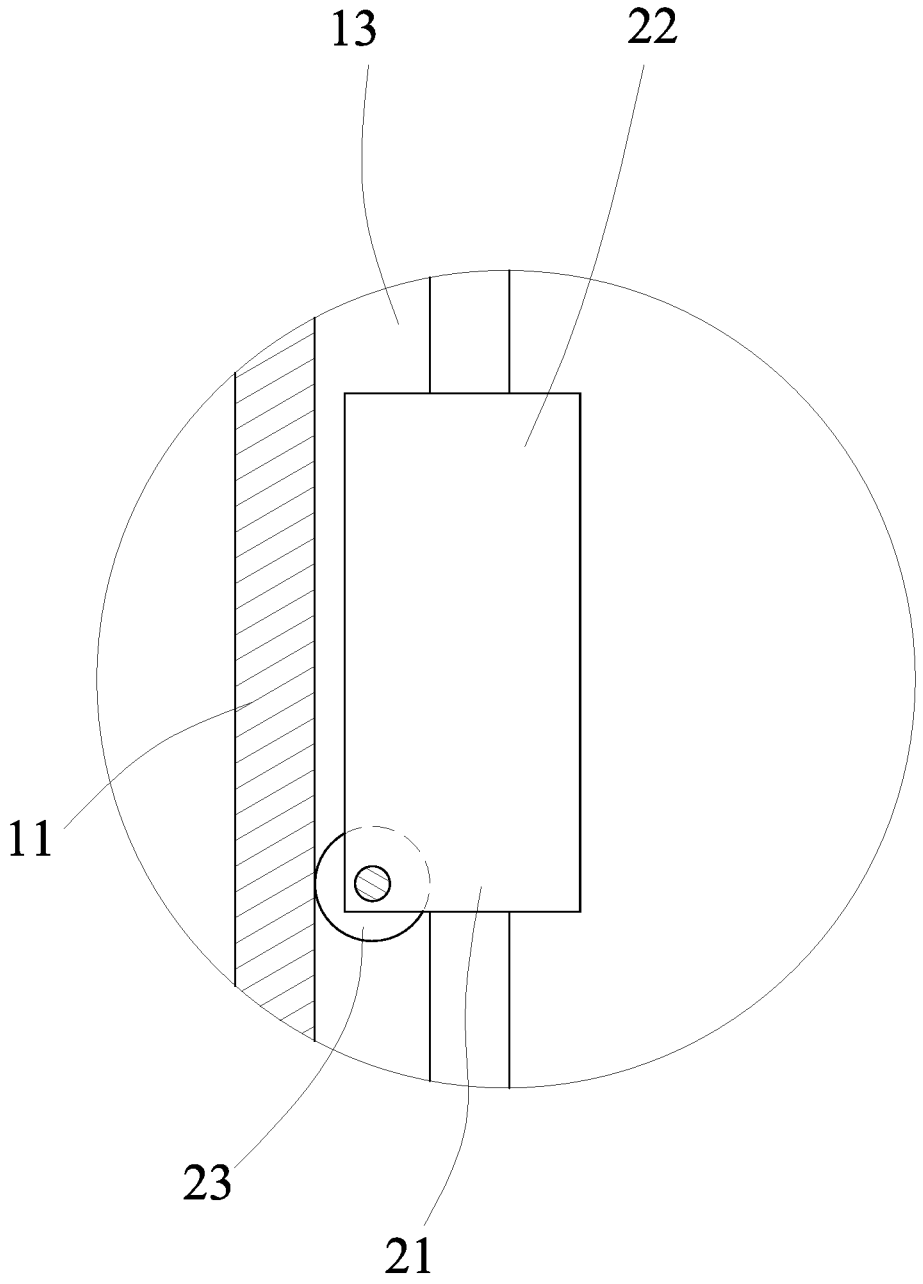
FIG. 10 is a schematic drawing showing a sliding block in a storage state according to the present invention.

Refer to FIG. 9, a further embodiment of the present invention is revealed. Apart from a linear ladder formed by a single ladder body 1 mentioned above, another type of the ladder is formed by two ladder bodies 1 arranged linearly and connected to each other. A plurality of hinges 5 is arranged at and pivotally connected to one end of each of the two ladder bodies 1 adjacent to each other so as to form an A-shaped ladder. When the user needs to work at height, the two ladder bodies 1 are extended to have a distance between the other end thereof for standing on the ground. While being used as the bridge, the two ladder bodies 1 are extended completely so that the ends of the ladder bodies 1 pivotally connected to the hinges 5 are joined to form a bridge with a larger length for transporting objects over a longer distance. Also refer to FIG. 10, the sliding block 2 and the assembly member 3 are separated when the present ladder is not in use. Then the assembly end 22 of the sliding block 2 protruding from the opening 133 of the sliding rail 13 of the ladder pole 11 is mounted into the sliding rail 13 for storage. Thereby the present ladder can be stored neatly. The storage also prevents the assembly end 22 of the sliding block 2 exposed from damages caused by collisions.

Figure 11:
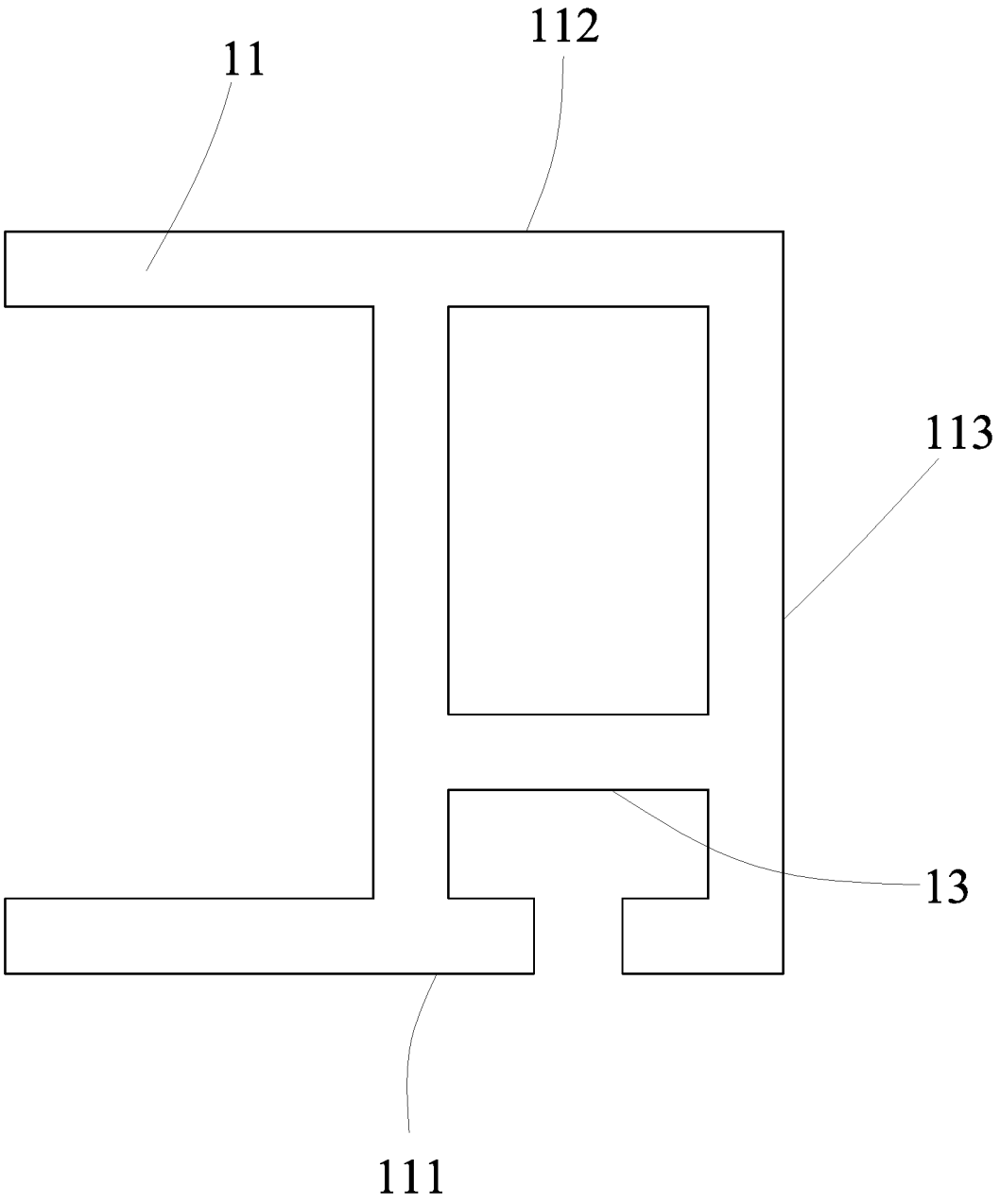
FIG. 11 is a top view of a further embodiment according to the present invention.
Figure 12:
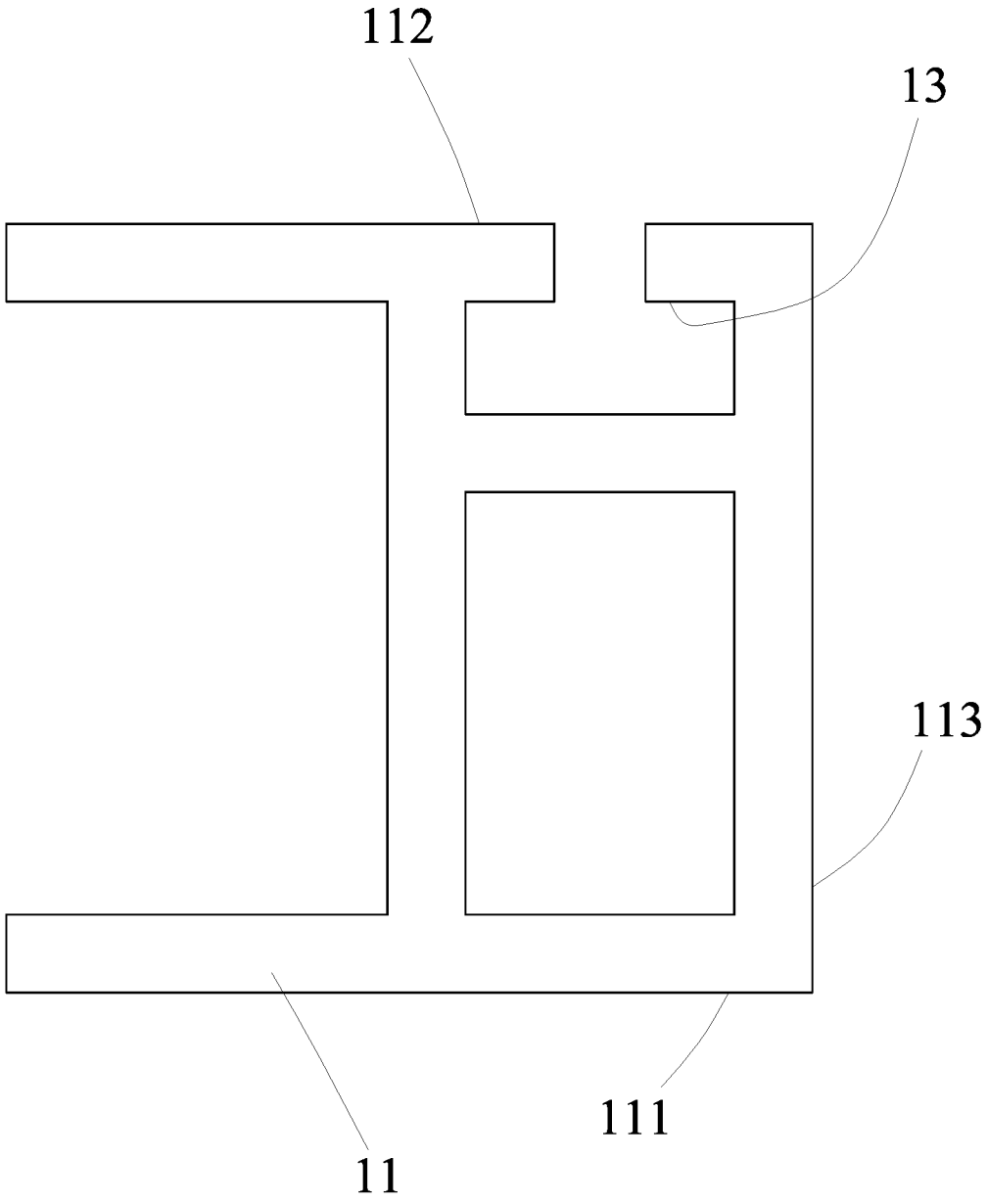
FIG. 12 is a top view of a further embodiment according to the present invention.
Figure 13:
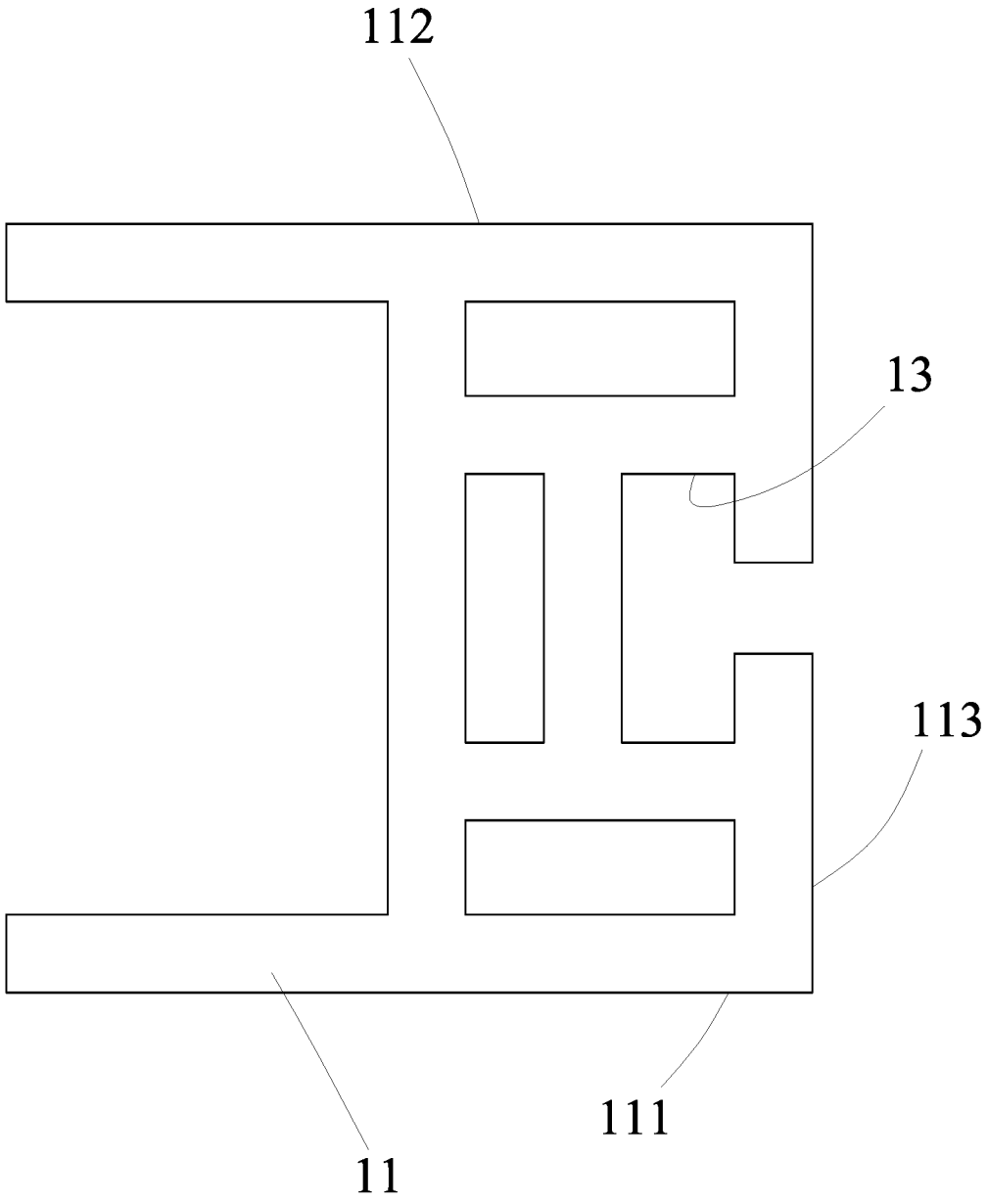
FIG. 13 is a top view of a further embodiment according to the present invention.
Figure 14:
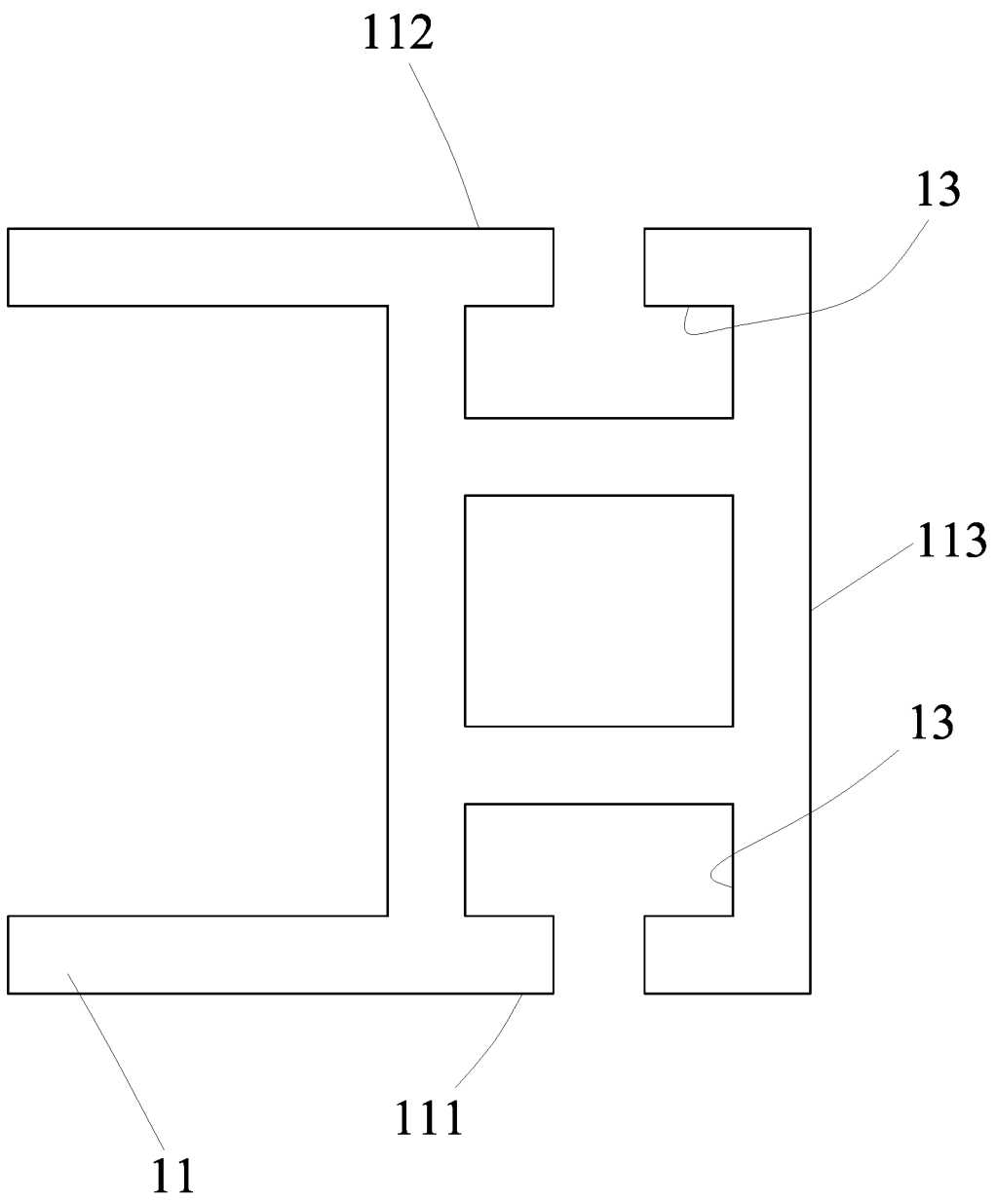
FIG. 14 is a top view of a further embodiment according to the present invention.
Figure 15:
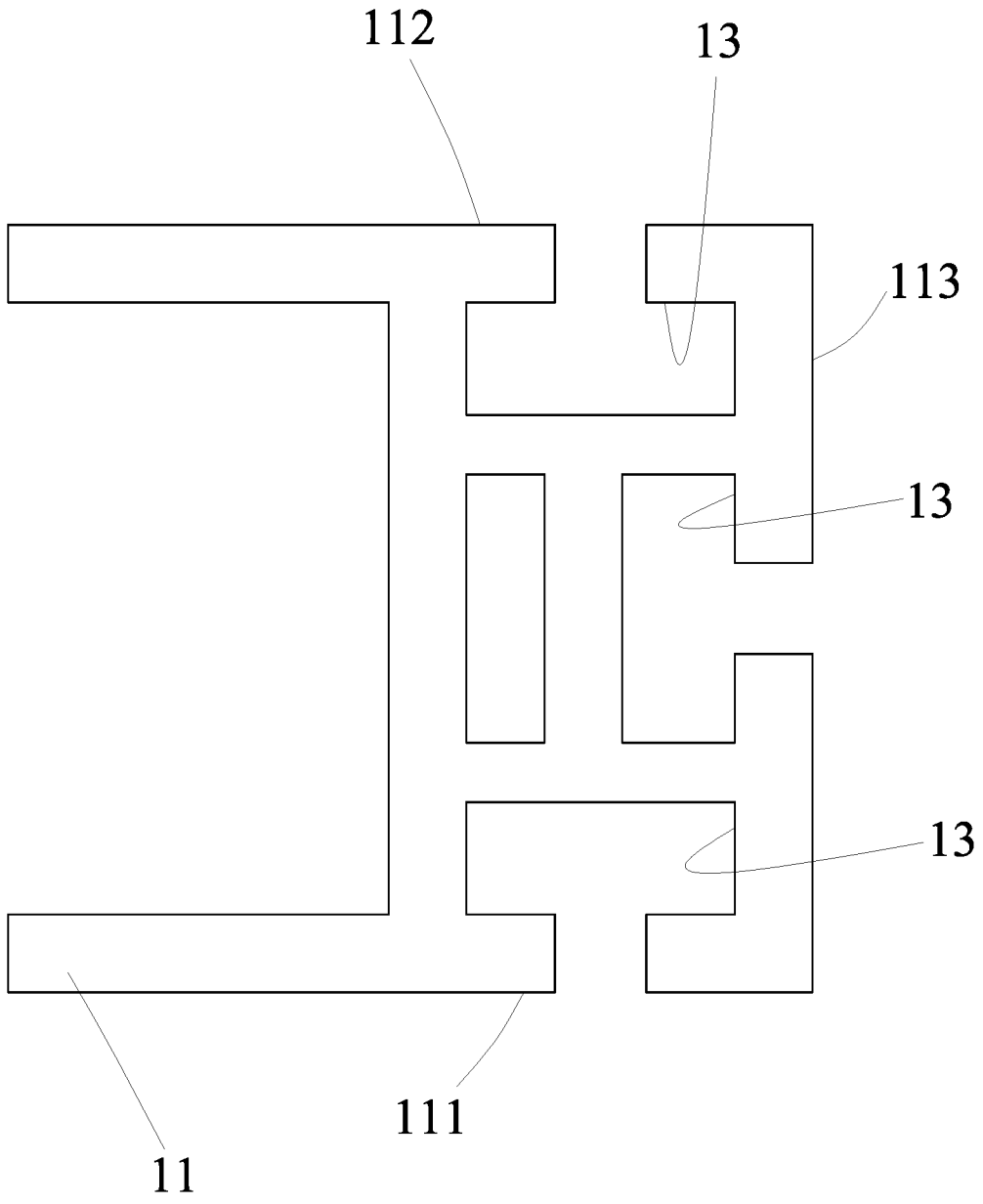
FIG. 15 is a top view of a further embodiment according to the present invention.

Refer to FIG. 11-FIG. 15, further embodiments are revealed. A front surface 111 and a rear surface 112 are formed on the ladder pole 11 and opposite to each other. A lateral surface 113 is formed on one side of the ladder pole 11 and located between the front surface 111 and the rear surface 112. The sliding rail 13 is arranged at the front surface 111 of the ladder pole 11, as shown in FIG. 11. The sliding rail 13 can also be disposed on the rear surface 112 of the ladder pole 11, as shown in FIG. 12, or on the lateral surface 113 of the ladder pole 11, as shown in FIG. 13. In a further embodiment, both the front surface 111 and the rear surface 112 are provided with the sliding rail 13 respectively, as shown in FIG. 14. Refer to FIG. 15, the sliding rail 13 is formed on the front surface 111, the rear surface 112 and the lateral surface 113 of the ladder pole 11 respectively.

Figure 16:
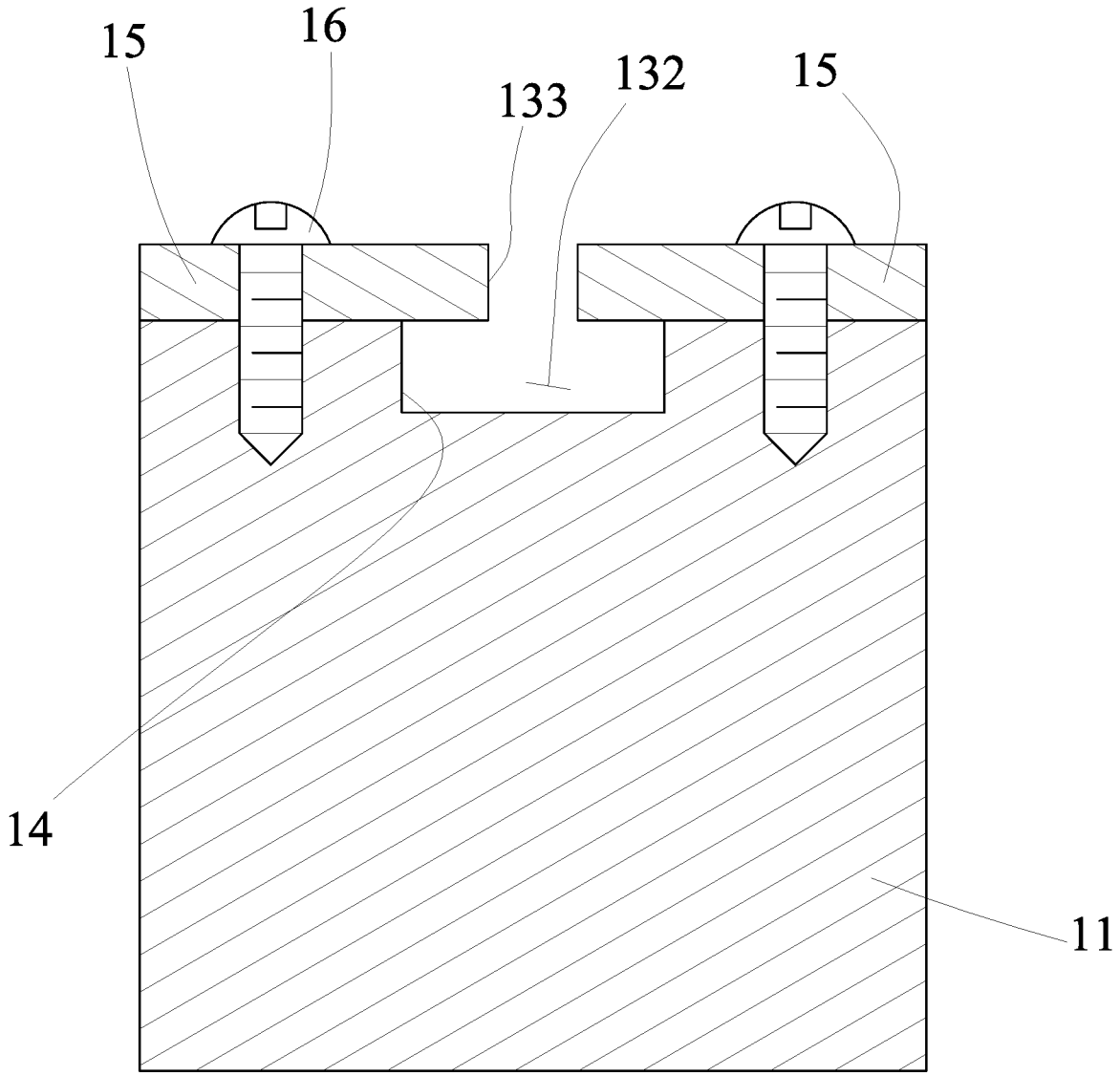
FIG. 16 is a sectional view of a further embodiment according to the present invention.

Refer to FIG. 16, a further embodiment is revealed. The ladder pole 11 of the ladder body 1 and the sliding rail 13 of the ladder pole 11 can be formed integrally by aluminum extrusion. Or a slot 14 is formed on one surface of the ladder pole 11 and a rail 15 is fastened on each of two sides of the slot 14 on the surface of the ladder pole 11 by a fastener 16 respectively, and one side of the rail 15 is extended to the slot 14. Thus a track 132 is formed among the two rails 15 and the slot 14. A gap between the two rails 15 forms an opening 133 whose width is smaller than the width of the track 132. The opening 133 is communicating with the track 132. The assembly end 22 of the sliding block 2 is protruding from the opening 133 of the sliding rail 13 to be outside the track 132.

Figure 17:
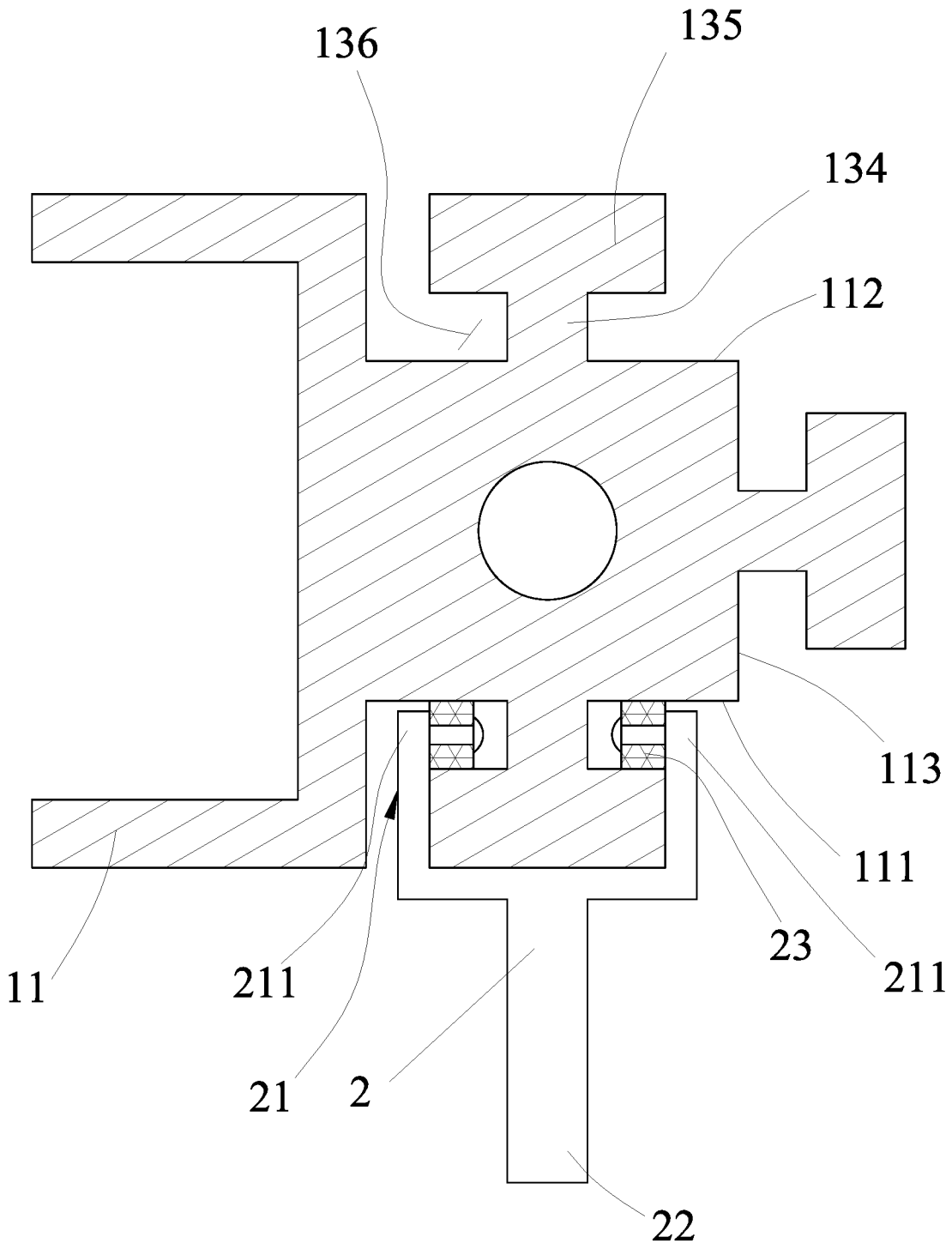
FIG. 17 is a sectional view of a further embodiment according to the present invention.

With reference to FIG. 17, a further embodiment is disclosed. The sliding rail 13 of the ladder pole 11 further includes a rail 134. One end of the rail 134 is connected to the center of the surface of the ladder pole 11 and the other end thereof is provided with two ribs 135. The two ribs 135 are corresponding to each other and two tracks 136 are formed between the ribs 135 and the surface of the ladder pole 11 respectively. Two braking portions 211 corresponding to each other are disposed on the braking end 21 of the sliding block 2 and located in the two tracks 136 of the sliding rail 13 respectively. A wheel 23 is arranged at each of the two braking portions 211 of the sliding block 2. The assembly end 22 of the sliding block 2 is protruding from the track 136 of the sliding rail 13. The sliding rail 13 can be arranged at one of the following positions—the front surface 111, the rear surface 112 and the lateral surface 113 of the ladder pole 11.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A ladder comprising:

at least one ladder body that includes two vertical ladder poles corresponding to each other, a plurality of horizontal rungs disposed between the two ladder poles and spaced apart, and at least one sliding rail that is formed on at least one surface on one side of each ladder pole, each at least one sliding rail being arranged lengthwise and having two rails spaced apart one from the other and a track disposed internal to respective ones of the two ladder poles, wherein a slot is formed in a surface of each of the ladder poles of the ladder body, and each rail is removably fastened on each of two sides of the slot on the surface of each of the ladder pole;

at least two sliding blocks each of which is mounted and sliding in a respective one of the at least one sliding rail formed on each of the ladder poles, each sliding block having a braking end placed in the track of the respective one of the at least one sliding rail, and thereby internal to a corresponding one of the ladder poles, and an assembly end opposite to the braking end and protruding from the track of the respective one of the at least one sliding rail; and at least one assembly member that is arranged between the at least two sliding blocks respectively located at the two ladder poles, and opposing end portions of the at least one assembly member are respectively connected to the assembly ends of the two sliding blocks.

2. The ladder as claimed in claim 1, wherein the braking end of the sliding block is provided with at least one wheel.

3. The ladder as claimed in claim 1, wherein the assembly member is a hook chain that includes a plurality of holes formed thereof and a hook arranged at the hole at the center of the hook chain.

4. The ladder as claimed in claim 1, wherein the assembly member is a shelf board.

5. The ladder as claimed in claim 1, wherein the ladder includes two ladder bodies arranged linearly and connected to each other; at least one hinge is arranged at and pivotally connected to one end of each of the two ladder bodies adjacent to each other.

6. The ladder as claimed in claim 1, wherein a front surface and an opposing rear surface are formed on each of the ladder poles; a lateral surface is formed on one side of each of the ladder poles and located between the front surface and the rear surface; the at least one sliding rail is disposed on the front surface of each of the ladder poles.

7. The ladder as claimed in claim 1, wherein a front surface and an opposing rear surface are formed on each of the ladder poles; a lateral surface is formed on one side of each of the ladder poles and located between the front surface and the rear surface; the at least one sliding rail is disposed on the rear surface of each of the ladder poles.

8. The ladder as claimed in claim 1, wherein a front surface and an opposing rear surface are formed on each of the ladder poles; a lateral surface is formed on one side of each of the ladder poles and located between the front surface and the rear surface; the at least one sliding rail is disposed on the lateral surface of each of the ladder poles.

9. The ladder as claimed in claim 1, wherein the two rails of the at least one sliding rail of each of the ladder poles of the ladder body protrude from two opposite lateral sides of a surface of a corresponding one of the ladder poles; a gap is disposed between the two rails and forms an opening with a width of the opening being smaller than a width of the track and being in open communication with the track; the assembly end of a corresponding sliding block protrudes through the opening to be external to the track.

* * * * *